United States Patent [19]

Bohner

[11] Patent Number: 4,681,611

[45] Date of Patent: Jul. 21, 1987

[54] WINE TEMPERATURE CONTROLLER

[76] Inventor: Hal J. Bohner, 582 Farallon Ave., Pacifica, Calif. 94044

[21] Appl. No.: 853,476

[22] Filed: Apr. 18, 1986

Related U.S. Application Data

[63] Continuation-in-part of Ser. No. 748,705, Jun. 25, 1985, abandoned, which is a continuation-in-part of Ser. No. 604,526, Apr. 27, 1984, abandoned.

[51] Int. Cl.[4] ..... F25B 21/02

[52] U.S. Cl. ..... 62/3; 62/457

[58] Field of Search ..... 62/3, 457

[56] References Cited

U.S. PATENT DOCUMENTS 2,991,628 7/1961 Tuck ..... 62/3
3,500,649 3/1970 Feldman ..... 62/3

FOREIGN PATENT DOCUMENTS 1139858 11/1962 Fed. Rep. of Germany ..... 62/3
949318 2/1964 United Kingdom ..... 62/3

*Primary Examiner*—Lloyd L. King

[57] ABSTRACT

A device and process for maintaining a bottle of wine at substantially a predetermined temperature while the wine is being served is disclosed. The device is portable and is capable of keeping the bottle of wine at substantially a predetermined temperature. The process includes maintaining a heat conduction member of the device at the predetermined temperature; the bottle is kept in heat transfer relationship with the heat conduction means when the wine is not being served, and the bottle is removed from the heat conduction means when the wine is served.

11 Claims, 3 Drawing Figures

WINE TEMPERATURE CONTROLLER

BACKGROUND OF THE INVENTION

This application is a continuation-in-part of my prior co-pending application Ser. No. 748,705 filed June 25, 1985, which is a continuation of application Ser. No. 604,526 filed Apr. 27, 1984, both of which are now abandoned.

1. Field of Invention

The present invention concerns a device for keeping a bottle of wine chilled while the wine is being served.

2. State of the Art

It is known that certain wines are best served at certain temperatures. For example, one source indicates preferred temperatures for various wines such as about 34°–41° Fahrenheit for "sweet white", 44°–53° Fahrenheit for "young dry whites", and 52°–61° Fahrenheit for "aged dry whites". "Playboy's Book of Wine" by Peter A. Gillette, copyright 1974.

There is presently only one device commonly used for chilling a bottle of wine and maintaining it at a predetermined temperature throughout a meal. The device is the ice bucket. However, the ice bucket has serious disadvantages. For example, it is capable of maintaining the bottle at only a single temperature of about 32° Fahrenheit. However, many wines are best served at a temperature other than 32° Fahrenheit.

Also, the ice bucket is inconvenient in that it must be supplied with fresh ice, generally for each bottle of wine.

OBJECTS OF THE INVENTION

An object of the present invention is to provide a process and a device for insuring that wine which is being drunk from a glass is at substantially a predetermined temperature.

Another object is to provide a device which is portable and can be located near the plate where wine is being served to maintain the wine at substantially a predetermined temperature.

Further objects and advantages of the present invention can be ascertained with reference to the specification and drawings herein which are offered by way of example only and not in limitation of the invention which is defined by the claims and equivalents thereof.

DETAILED DESCRIPTION THE PREFERRED EMBODIMENTS

Figure 1:
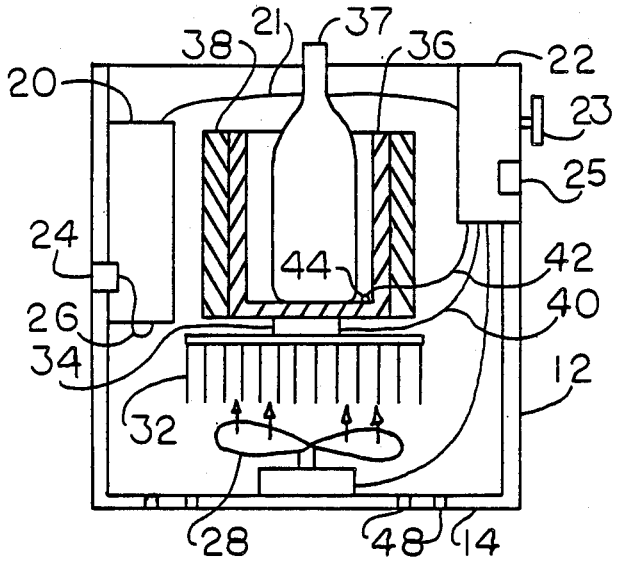
FIG. 1 is a schematic sectional view of the present embodiment.

With reference to FIG. 1, the present embodiment includes a container having sides 12 and a floor 14. The container can be cylindrical or rectangular or have other shapes, and it is open at the top.

A battery 20 is mounted on the side 12. The battery 20 is rechargeable from a suitable source, not shown. The battery 20 is of the nickel-cadmium type or the sealed lead-acid type. An electrical coupling 24 is mounted in the wall 12 adjacent the battery 20, and the coupling 24 is electrically connected to the battery by wire pair 26 so that when it is desired to charge the battery 20 the charging source, not shown, can be connected to the coupling 24.

A suitable battery should have at least a 12 amp-hour capacity of 5 volts or greater in order to adequately power the device. However, the battery should be relatively light to insure that the present device of which the battery is an integral part, is portable. For example, the battery could be a sealed lead-acid battery model EP 6120-1 manufactured by the Elpower Corporation which has a 12 amp-hour capacity at 6 volts and weighs 5.5 pounds.

A controller 22 is connected to the battery 20 and is mounted on the wall 12. The controller includes a dial 23 and a display 25.

A fan 28 is mounted on the floor 14, and the fan is connected to the controller 22 by wire pair 30. A heat sink 32 is mounted above the fan 28, and a thermoelectrical cooling device 34 is mounted on the flat upper surface of the heat sink 32.

The thermoelectric cooling device 34 is a solid state device operating upon the Peltier principle wherein, when current is passed through the device, its first face is cooled and its second face is heated. Conversely, when current is applied to the device in the opposite direction, the first face is heated and the second face is cooled.

A hollow cylinder 36 is mounted above the thermoelectric device 34 in heat-flow contact therewith. The cylinder 36 is formed of a material which has high thermal conductivity, such as aluminum, and the interior of the cylinder is sufficient to accommodate a wine bottle 37. Thermal insulation 38 encloses the cylinder 36.

The thermoelectric cooling device 34 is electrically connected to the controller 22 by wire pair 40 so that electric power can be controllably supplied to the thermo-electric device 34. The controller 22 is electrically connected by wire pair 42 to a thermocouple 44 which is affixed in heat transfer relationship with the cylinder 36. Wire pair 46 connects the fan 28 to the controller 22.

In operation the dial 23 of the controller 22 can be set to a desired setpoint temperature, and the controller then operates so that when the thermocouple 44 measures a temperature above the setpoint, current is applied to the thermoelectric device 34 so that the upper face of the device is cooled and the lower face is heated. Thus the cylinder 36 is cooled until it reaches the setpoint temperature. On the other hand, if the temperature measured by the thermocouple 44 is below the setpoint, the controller operates to apply current to the thermoelectric device 34 so that the upper face is heated and the lower face is cooled. Thus the temperature of the cylinder 36 is raised to the setpoint. The controller 22 also operates to turn the fan 28 on when current is applied to the thermoelectric device so that a stream of ambient air from ports 48 in the floor 14 is directed across the heat sink 32.

Figure 2:
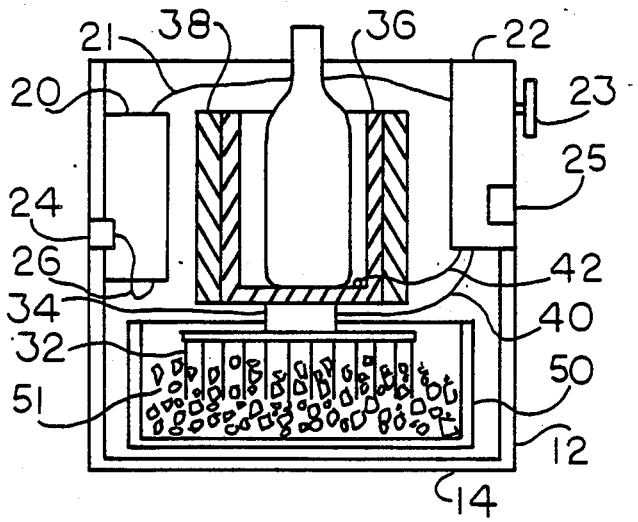
FIG. 2 is a schematic sectional view of another embodiment.

FIG. 2 illustrates an alternative embodiment, which includes many of the same components as the FIG. 1 embodiment. However, the FIG. 2 embodiment does not include a fan. Rather, a coolant container 50 is mounted below the heat sink 32. In operation the container 50 is filled with a coolant material such as ice 51 to contact the heat sink 32 and cool the heat sink below ambient temperature.

In some applications the embodiment in FIG. 2 is preferred over that shown in FIG. 1. For example, in order to provide sufficient current to power the thermoelectric device 34 and the fan, the battery 20 must be fairly heavy. However, if coolant material is used the battery can be lighter thereby enhancing the portability of the device. Also, ice keeps the temperature of the heat sink 32 substantially lower than does a stream of ambient air supplied by the fan 28. If the temperature of the heat sink is lower, the thermoelectric device 34 operates more efficiently to cool the cylinder 36 and thus the wine can be cooled more quickly and with less electric power than if the fan were used.

Figure 3:
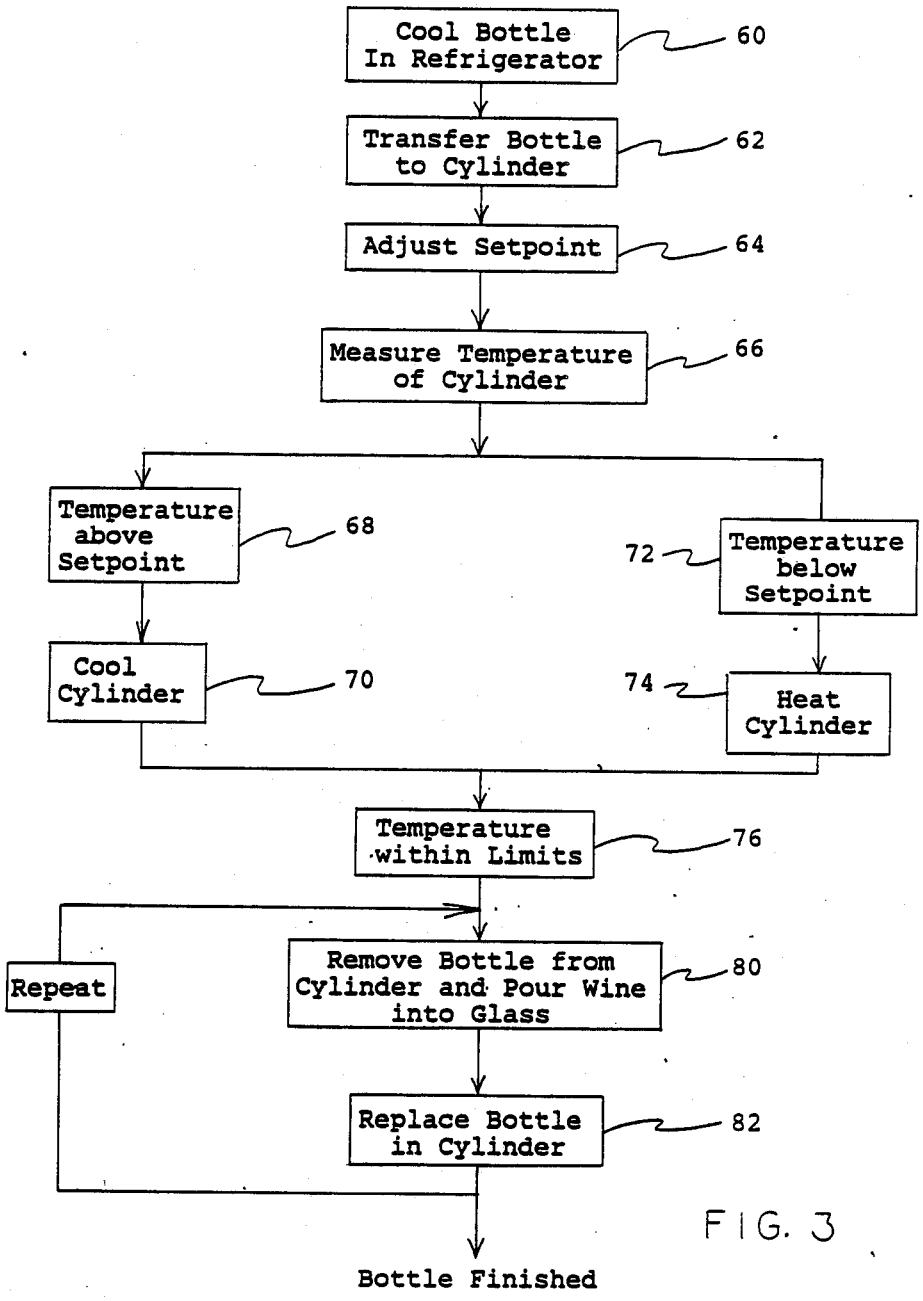
FIG. 3 is a diagram of the steps of the present process.

The process of the present embodiment is shown in FIG. 3. First, a bottle of wine at room temperature is cooled to below room temperature. The bottle could be cooled from ambient temperature in the present device, or the bottle could be cooled in a refrigerator, according to step 60, and then transferred to the present device according to step 62. In practice the bottle could be chilled in a refrigerator which in a restaurant would be located relatively far away from the tables where the wine would be served. The temperature of the wine when removed from the refrigerator would, of course, be the same as the interior of the refrigerator. Thus the temperature of the wine would be significantly below normal room temperature, but the wine would not necessarily be at the temperature which would be preferred for serving.

When the bottle of wine is removed from the refrigerator, according to step 62 it is then placed in the present device which is located near the serving location which in a restaurant would be the customer's table. According to step 64, the dial 23 on the controller 22 is set to a predetermined setpoint temperature, which could be based upon prior experience of the waiter serving the wine, the desire of the consumer of the wine or a predetermined schedule of temperatures for certain classes of wine. The schedule could be based on the type of wine and its age.

The predetermined setpoint temperature could be the desired serving temperature of the wine when the wine is being drunk. Alternatively, the dial 23 could be set to a setpoint temperature which would be a predetermined amount below the preferred temperature for drinking the wine. The predetermined amount could be determined based upon the expected extent to which the wine would warm in the consumer's glass before being drunk. For example, I have found that in some circumstances a glass of wine can warm about six degrees Fahrenheit during the first five minutes after being poured from the bottle and about twelve degrees during the first fifteen minutes. Thus, if desired, the dial should be set about 0–12 degrees Fahrenheit below the preferred temperature for drinking the wine.

When the bottle is removed from the refrigerator it may be above or below the setpoint, and the bottle either heats or cools the cylinder 36 depending upon their relative temperatures. The bottle should be left in the cylinder a sufficient time for the bottle and the cylinder to reach substantially the same temperature. Then, according to step 66 if the temperature measured by thermocouple 44 is above the setpoint, controller 22 applies current to the thermoelectric cooling device 34 to cool the cylinder 36 and the bottle 37 according to steps 68 and 70. On the other hand, if the temperature of the cylinder is below the setpoint, the controller applies current to the thermoelectric device to heat the cylinder according to steps 72 and 74. The temperature of the cylinder 36 is shown on display 25, and when the temperature is within the desired range according to step 76, the consumer can remove the bottle from the cylinder 36 and pour the wine into his glass, step 80. After pouring, the bottle is returned to cylinder 36, step 82, and the controller continues to maintain the temperature of the cylinder substantially at the setpoint. Each time the wine is poured thereafter according to 80 the bottle is replaced in the cylinder according to step 82.

I claim:

1. A process for maintaining a bottle of wine at substantially a predetermined temperature while the wine is being served, utilizing a portable device capable of maintaining the bottle of wine at substantially a predetermined temperature, the device including heat conduction means which can be located in heat transfer relationship with the bottle, the process comprising:

a. cooling the bottle of wine using a non-portable system;

b. thereafter removing the bottle of wine from the non-portable system and transferring the bottle to the portable device located near the place at which the wine is to be served so that the bottle is in heat transfer relationship with the heat conduction means;

c. maintaining the heat conduction means at substantially the predetermined temperature;

d. measuring a temperature corresponding to the temperature of the wine at a time no less than a predetermined time after the bottle has been transferred to the portable cooling device;

e. determining whether the measured temperature is greater than a second predetermined value;

f. if the measured temperature is greater than the second value, allowing the bottle to remain in heat transfer relationship with the heat conduction means;

g. removing the bottle from the portable device to pour wine into a glass after the measured temperature has reached the second predetermined value; and, h. returning the bottle to the portable device when the wine is not being poured so that the wine is maintained at substantially the predetermined temperature.

2. A process according to claim 1 further including the following steps:

a. selecting a desired serving temperature for the wine in the glass; and, b. maintaining the heat conduction means at a predetermined temperature which is different from the desired serving temperature.

3. A process according to claim 1 wherein the second predetermined value is different from the predetermined temperature.

4. A process according to claim 2 wherein said predetermined temperature is less than said desired serving temperature.

5. A process according to claim 4 wherein said predetermined temperature is between about zero degrees Fahrenheit and about twelve degrees Fahrenheit less than said desired serving temperature.

6. A process according to claim 4 wherein said predetermined temperature is about six degrees Fahrenheit below said desired serving temperature.

7. A process according to claim 2 wherein the desired serving temperature is selected based upon the type of wine.

8. A process according to claim 2 wherein the desired serving temperature is also selected based upon the age of the wine.

9. A process for maintaining a bottle of wine at substantially a predetermined temperature while the wine is being served, utilizing a portable device capable of maintaining the bottle of wine at substantially a predetermined temperature, the device including heat conduction means which can be located in heat transfer relationship with the bottle, the process comprising:

a. cooling the bottle of wine from ambient temperature with the portable cooling device while the bottle is in heat transfer relationship with the heat conduction means;

b. maintaining the heat conduction means at substantially the predetermined temperature;

c. measuring a temperature corresponding to the temperature of the wine at a time no less than a predetermined time after the bottle has been located in heat transfer relationship with the heat conduction means;

d. determining whether the measured temperature is greater than a second predetermined value;

e. if the measured temperature is greater than the second value, allowing the bottle to remain in heat transfer relationship with the heat conduction means;

f. removing the bottle from the portable device to pour wine into a glass after the measured temperature has reached the second predetermined value; and, g. returning the bottle to the portable device when the wine is not being poured so that the wine is maintained at substantially the predetermined temperature.

10. A process according to claim 9 further including the following steps:

a. selecting a desired serving temperature for the wine in the glass; and, b. maintaining the heat conduction means at a predetermined temperature which is different from the desired serving temperature.

11. A process according to claim 9 wherein the second predetermined value is different from the predetermined temperature.

* * * * *